US012644346B2

(12) United States Patent
Deutsch et al.

(10) Patent No.: US 12,644,346 B2
(45) Date of Patent: Jun. 2, 2026

(54) BREAKAWAY LINK FOR A SLIPS LIFTER

(71) Applicant: Nabors Drilling Technologies USA, Inc., Houston, TX (US)

(72) Inventors: Eric Deutsch, Houston, TX (US); Johnny Harris, Tulsa, OK (US); Nathan Rose, Pinehurst, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/985,757

(22) Filed: Dec. 18, 2024

(65) Prior Publication Data

US 2025/0198244 A1 Jun. 19, 2025

Related U.S. Application Data

(60) Provisional application No. 63/612,133, filed on Dec. 19, 2023.

(51) Int. Cl.
*E21B 19/07* (2006.01)

(52) U.S. Cl.
CPC ..... *E21B 19/07* (2013.01)

(58) Field of Classification Search
CPC ..... E21B 19/07; E21B 19/10
See application file for complete search history.

(56) References Cited

U.S. PATENT DOCUMENTS 1,643,750 A * 9/1927 Pearson ..... E21B 19/10 175/423
2,594,446 A 4/1952 Kelley
3,097,409 A * 7/1963 Kelley ..... E21B 19/10 74/110
3,206,227 A * 9/1965 Todd ..... E21B 33/043 166/98
4,715,456 A * 12/1987 Poe, Jr. ..... E21B 19/10 188/67
5,848,647 A * 12/1998 Webre ..... E21B 19/07 188/67
6,948,575 B1 * 9/2005 Mosing ..... E21B 19/00 166/380
8,037,932 B2 10/2011 Carr et al.
8,316,929 B2 * 11/2012 Angelle ..... E21B 17/012 166/77.1
10,801,276 B2 10/2020 Bergeron et al.
2003/0227187 A1 12/2003 Bunn
2005/0072882 A1 * 4/2005 Mong ..... E21B 19/12 248/65
2005/0155797 A1 * 7/2005 Campisi ..... E21B 19/10 166/75.14
2007/0235229 A1 * 10/2007 Henderson ..... E21B 19/10 175/423

(Continued)

*Primary Examiner* — Shane Bomar
(74) *Attorney, Agent, or Firm* — Abel Schillinger, LLP

(57) ABSTRACT

A system that can include slips configured to selectively engage a tubular string that extends into a wellbore, a slips lifter configured to selectively raise or lower the slips, and a link configured to decouple the slips from the slips lifter when the slips are rotated relative to the slips lifter. A method that can include operations of coupling a slips lifter, via a link, to slips on a rig floor, engaging the slips to a tubular, rotating the slips relative to the slips lifter, and decoupling the slips from the slips lifter by decoupling a first element of the link from a second element of the link in response to rotation of the slips.

19 Claims, 8 Drawing Sheets

(56) References Cited

U.S. PATENT DOCUMENTS

| | | | | |
|---|---|---|---|---|
| 2012/0090828 | A1* | 4/2012 | Webre | E21B 17/026 29/428 |
| 2019/0093439 | A1 | 3/2019 | Kauffmann et al. | |
| 2022/0186571 | A1* | 6/2022 | Lien | B25J 15/0253 |
| 2024/0301757 | A1* | 9/2024 | Gustafson | E21B 19/00 |

* cited by examiner

Cross-sectional line 5B-5B

BREAKAWAY LINK FOR A SLIPS LIFTER

CROSS-REFERENCE TO RELATED APPLICATION(S)

This application claims priority under 35 U.S.C. § 119(e) to U.S. Provisional Patent Application No. 63/612,133, filed on Dec. 19, 2023, entitled "BREAKAWAY LINK FOR A SLIPS LIFTER," by Eric DEUTSCH et al., which is assigned to the current assignee hereof and is incorporated herein by reference in its entirety.

FIELD OF THE DISCLOSURE

The present invention relates, in general, to the field of drilling and processing of wells. More particularly, present embodiments relate to a system and method for protecting a slips lifter during subterranean operations.

BACKGROUND

Existing technologies can have a slips lifter that assists rig operators in manipulating slips on a rig floor during subterranean operations. The slips are used to carry the weight of the tubular string that extends into a wellbore when the top drive (or other pipe handler) is to be disconnected from the tubular string. When the top drive is again reconnected with the tubular string, then the slips are disengaged to prevent interference of the slips with operation of the tubular string. However, sometimes the tubular string can be rotated before the slips are disengaged from the tubular string. Since the slips lifter is not equipped to handle rotation of the slips, damage can occur that requires operations to stop for repairs to the slips lifter, the slips, or the well center equipment. Therefore, improvements in manipulating slips are continually needed.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a system for protecting a slips lifter during a subterranean operation. The system also includes slips configured to selectively engage a tubular string that extends into a wellbore; a slips lifter configured to selectively raise or lower the slips, and a link configured to decouple the slips from the slips lifter when the slips are rotated relative to the slips lifter.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method for protecting a slips lifter during a subterranean operation. The method also includes coupling a slips lifter, via a link, to slips on a rig floor; engaging the slips to a tubular, rotating the slips relative to the slips lifter, and decoupling the slips from the slips lifter by decoupling a first element of the link from a second element of the link in response to rotation of the slips. Other embodiments of this aspect include corresponding computer systems, apparatus, and computer programs recorded on one or more computer storage devices, each configured to perform the actions of the methods.

One general aspect includes a system for protecting a slips lifter during a subterranean operation. The system also includes slips configured to selectively engage a tubular string that extends into a wellbore; a slips lifter configured to selectively raise or lower the slips, and a link configured to decouple the slips from the slips lifter when the slips lifter attempts to lift the slips with the slips engaged with the tubular string. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Figure 1:
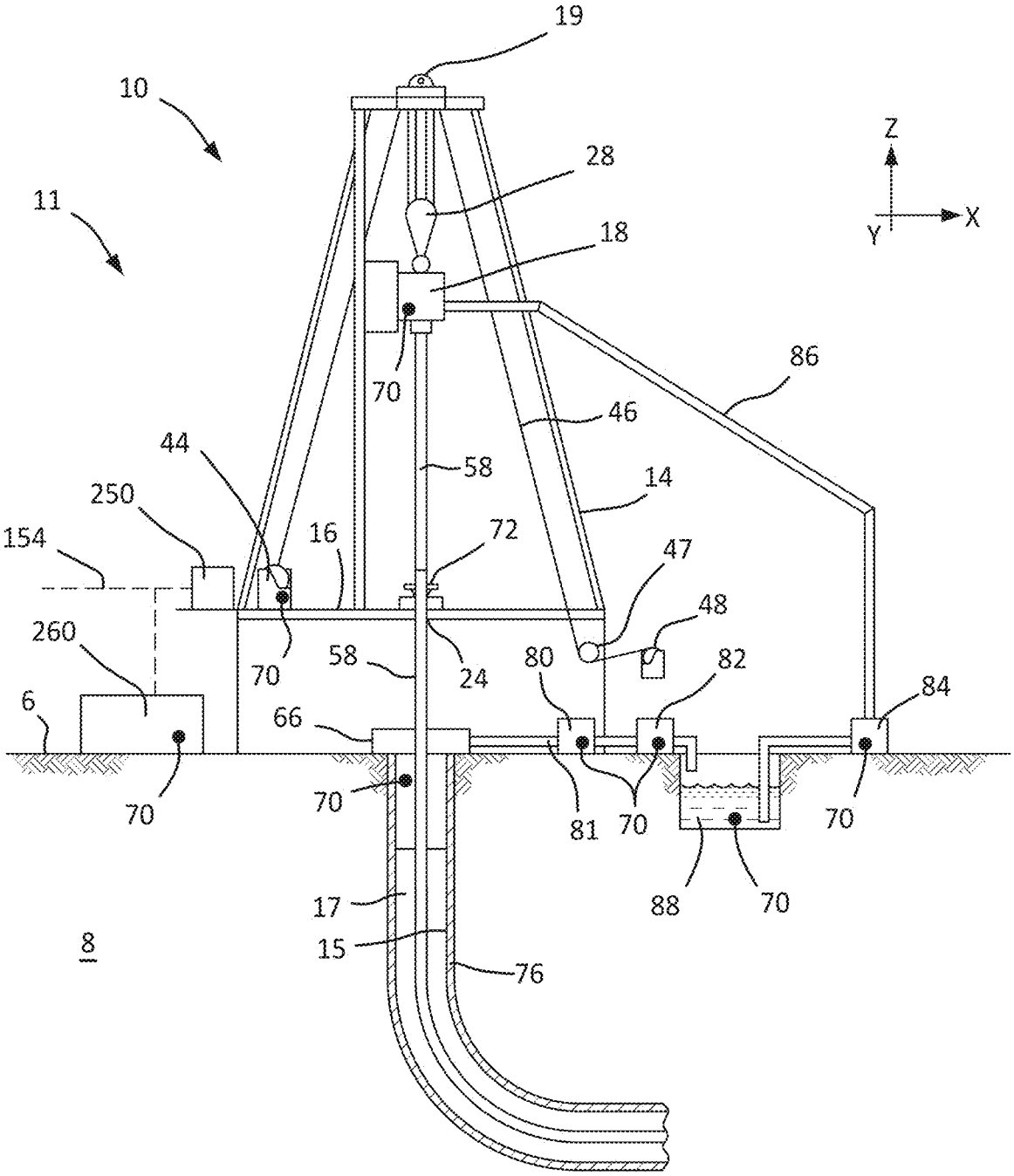
FIG. 1 is a representative partial cross-section view of a rig used to perform subterranean operations, in accordance with certain embodiments.

FIG. 1 is a representative partial cross-sectional front view of a rig 10 at a rig site 11 being used to drill a wellbore 15 in a subterranean formation 8, in accordance with certain embodiments. Rig 10 can include a top drive 18 with a drawworks 44, sheaves 19, traveling block 28, anchor 47, and reel 48 used to raise or lower the top drive 18 via cable 46. A derrick 14 extending from the rig floor 16, can provide the structural support of the rig equipment for performing subterranean operations (e.g., drilling, treating, completing, producing, testing, etc.).

The rig can be used to extend a wellbore 15 through the subterranean formation 8 by using a tubular string 58 having a bottom hole assembly at its lower end. During drilling operations, drilling mud can be pumped from the surface 6 into the tubular string 58 (e.g., via pumps 84 supplying mud to the top drive 18 via the standpipe 86) to cool and lubricate the drill bit and to transport cuttings to the surface via an annulus 17 between the tubular string 58 and the wellbore 15.

The returned mud can be directed to the mud pit 88 from a rotating control device 66, through the flow line 81, to the shaker 80. A fluid treatment 82 can inject additives as desired to the mud to condition the mud appropriately for the current well activities and possibly future well activities as the mud is being pumped to the mud pit 88. Pump 84 can pull mud from the mud pit 88 and drive it to the top drive 18, via standpipe 86, to continue circulation of the mud through the tubular string 58. The wellbore 15 can have casing string 76 installed in the wellbore 15 and extending down to a casing shoe.

A rig controller 250 can be used to control rig operations including controlling various rig equipment, such as a pipe handler, the top drive 18, an iron roughneck, fingerboard equipment, imaging systems, various other robots on the rig 10, or rig power systems 260. The rig controller 250 can control the rig equipment autonomously (e.g., without periodic operator interaction), semi-autonomously (e.g., with limited operator interaction such as initiating a subterranean operation, adjusting parameters during the operation, etc.), or manually (e.g., with the operator interactively controlling the rig equipment via remote control interfaces to perform the subterranean operation).

The rig controller 250 can include one or more processors with one or more of the processors distributed about the rig 10, such as in an operator's control hut, in a pipe handler, in an iron roughneck, in a vertical storage area, in the imaging systems, in various other robots, in the top drive 18, at various locations on the rig floor 16 or the derrick 14 or the platform 12, at a remote location off of the rig 10, at downhole locations, etc. It should be understood that any of these processors can perform control or calculations locally or can communicate to a remotely located processor for performing the control or calculations. Each of the processors can be communicatively coupled to a non-transitory memory, which can include instructions for the respective processor to read and execute to implement the desired control functions or other methods described in this disclosure. These processors can be coupled via a wired or wireless network 154.

Figure 2A:
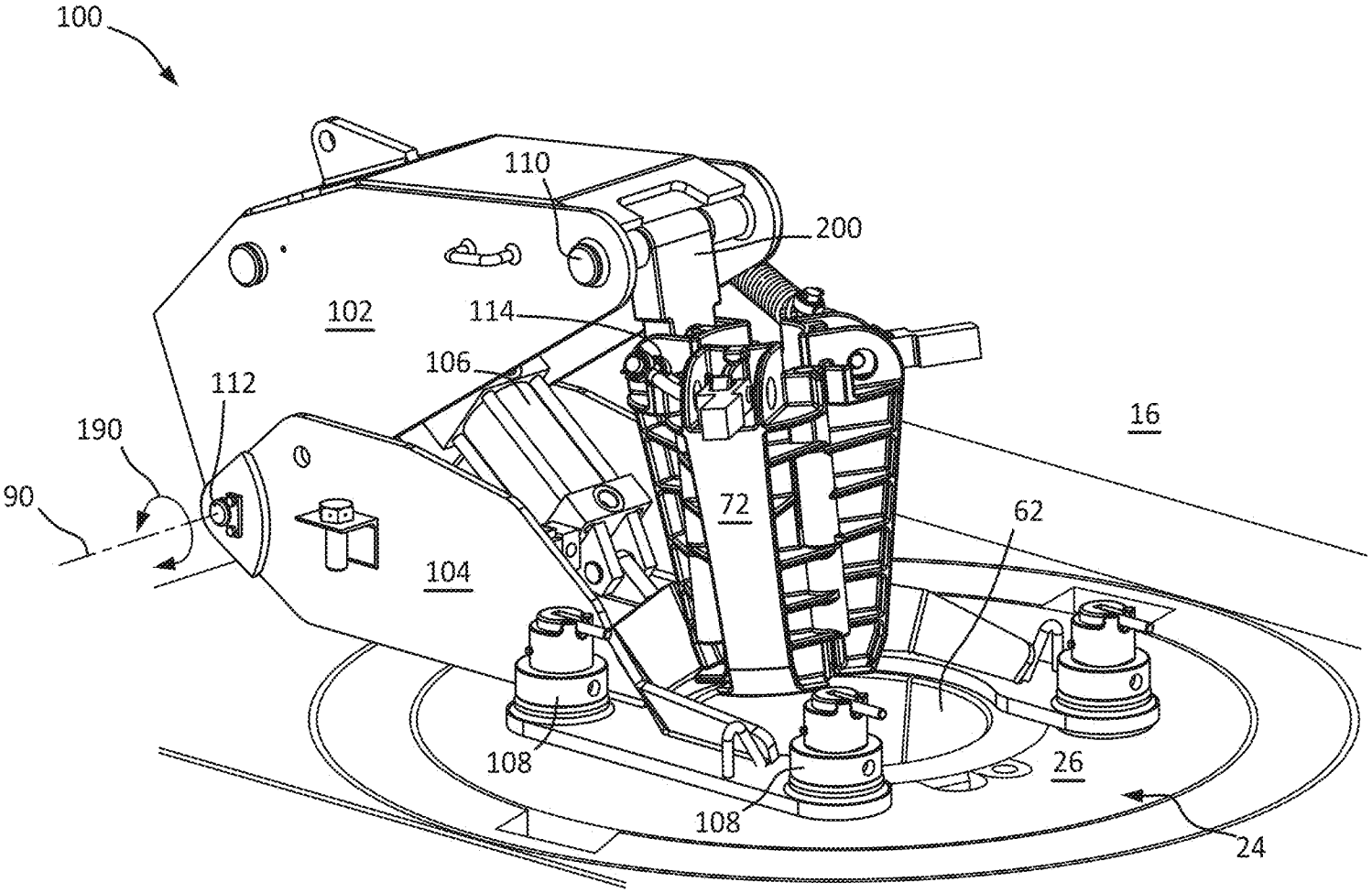
FIGS. 2A and 2B are representative perspective views of a slips lifter on a rig floor for manipulating slips into or out of the bowl at well center, in accordance with certain embodiments.

FIG. 2A is a representative perspective view of a slips lifter 100 for lifting the slips 72 from a bowl 62 at well center 24 to disengage the slips 72 from the bowl 62 and to prevent engagement with a tubular string 58. The slips lifter 100 can also be used to lower the slips 72 into the bowl 62 to enable engagement of the slips 72 with a tubular string 58. When the slips 72 are engaged with the tubular string 58 at well center 24, the slips 72 can carry the weight of the entire tubular string 58, such as when a tubular segment is being added to (tripping in) or removed from (tripping out) the tubular string 58. To disengage the slips 72 from the tubular string 58, the tubular string 58 can be lifted relative to well center 24, thereby removing the weight held by the slips 72. This can allow the slips lifter 100 to lift the slips 72 from the bowl 62 at well center 24, thereby removing engagement of the slips 72 from the tubular string 58 and allowing the tubular string 58 to be raised or lowered relative to the well center 24 without interference with the slips 72.

FIG. 2A shows the slips 72 raised from the bowl 62, via the slips lifter 100, to allow vertical movement of the tubular string 58 (not shown). The slips lifter 100 can have a base structure 104 that is coupled to the well center 24 (or rig floor 16 or master bushing 26) via one or more fasteners 108. The fasteners 108 can be any fasteners that can securely couple the base 104 to the rig floor, such as the quick release fasteners shown in FIG. 2A. A lift arm 102 can be rotationally coupled to the base 104 via a pivot 112, such that it can rotate (arrows 190) about the axis 90. When the actuator 106 is extended, the lift arm 102 can rotate upward relative to the base 104, and when the actuator 106 is retracted, the lift arm 102 can rotate downward relative to the base 104. The slips 72 can be coupled to the lift arm 102 via a link 200 being coupled to the slips 72 at one end and a pivot 110 at the other end. Therefore, when the lift arm 102 is rotated upward, the link 200 can lift the slips 72 away from the bowl 62, and when the lift arm 102 is rotated downward, the link 200 can lower the slips 72 toward the bowl 62.

Figure 2B:
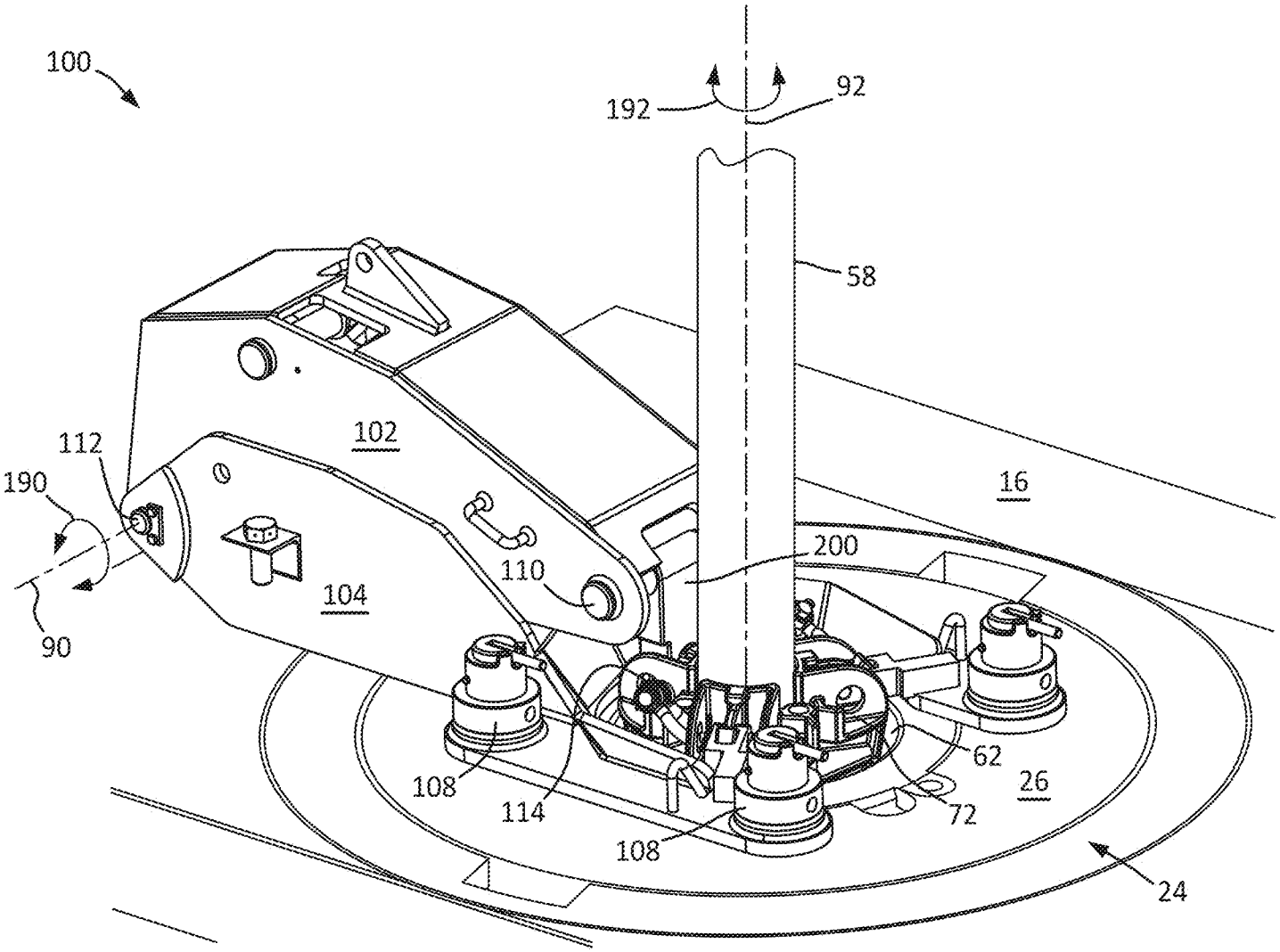

FIG. 2B shows the slips 72 lowered into the bowl 62 at well center 24 and engaged with a tubular string 58. When the slips 72 are disengaged from the tubular string 58, the tubular string 58 can be rotated (arrows 192) about the center axis 92 of the well center 24 by a pipe handler (e.g., top drive 18, robotic pipe handler, etc.). Unfortunately, the pipe handler may also attempt to rotate the tubular string 58 about the axis 92 when the slips 72 are engaged with the tubular string 58 or the slips lifter 100 may try to raise the slips 72 prior to the tubular string 58 being disengaged from the slips 72. Since the slips lifter 100 is engaged with the tubular string 58 via the slips 72, when the tubular string 58 is rotated, the slips 72 can also be rotated and possibly cause damage to the slips lifter 100. The current disclosure provides a breakaway link 200 that allows the slips lifter 100 to be decoupled from the slips 72 when the slips 72 are rotated due to engagement with the tubular string 58. The current disclosure also provides a breakaway link 200 that allows the slips lifter 100 to be decoupled from the slips 72 when the slips lifter 100 attempts to raise the slips 72 when they are still engaged with the tubular string 58.

The following figures illustrate various configurations of the breakaway link 200 for decoupling the slips 72 from the slips lifter 100 when the slips 72 are forced to rotate about the axis 92 relative to the slips lifter 100 or the slips 72 are attempted to be raised by the slips lifter 100 when the slips 72 are still engaged with the tubular string 58. In general, each of the configurations can include an upper element 210 and a lower element 220 that are coupled together by a shear element 230 that can fail when a pre-determined force is applied to the breakaway link 200, thereby decoupling the lower element 220 from the upper element 210 and allowing the lower element 220 to disengage from the upper element 210.

The breakaway link 200 can include a mating interface that engages a mating feature 212 of the upper element 210 with a mating feature 222 of the lower element 220. The mating features 212, 222 can be any features that engage with each other and have complimentary shapes that receive each other, such as the examples shown in the following figures. However, it should be understood that these configurations of the mating features 212, 222 shown in the following figures are non-limiting embodiments and that mating features 212, 222 with different configurations than these shown in the following figures are also envisioned by this disclosure. The mating features 212, 222 can engage each other to support the weight of the slips 72 when the slips 72 are lifted from the bowl 62. However, it is not required that the mating features 212, 222 support the weight of the slips 72, as shown in the FIGS. 6A, 6B, 7A. The shear element 230 can support the weight of the slips 72.

The breakaway link 200 can include an upper bore 214 that can engage the pivot 110 to manipulate the slips 72 via the breakaway link 200. The breakaway link 200 can rotate about the pivot 110 as the lift arm 102 is raised or lowered. The breakaway link 200 can include a lower bore 224 that can engage the pivot 114 to manipulate the slips 72 via the breakaway link 200. The breakaway link 200 can rotate about pivot 114 as the slips 72 are raised or lowered by the lift arm 102.

Figure 3B:
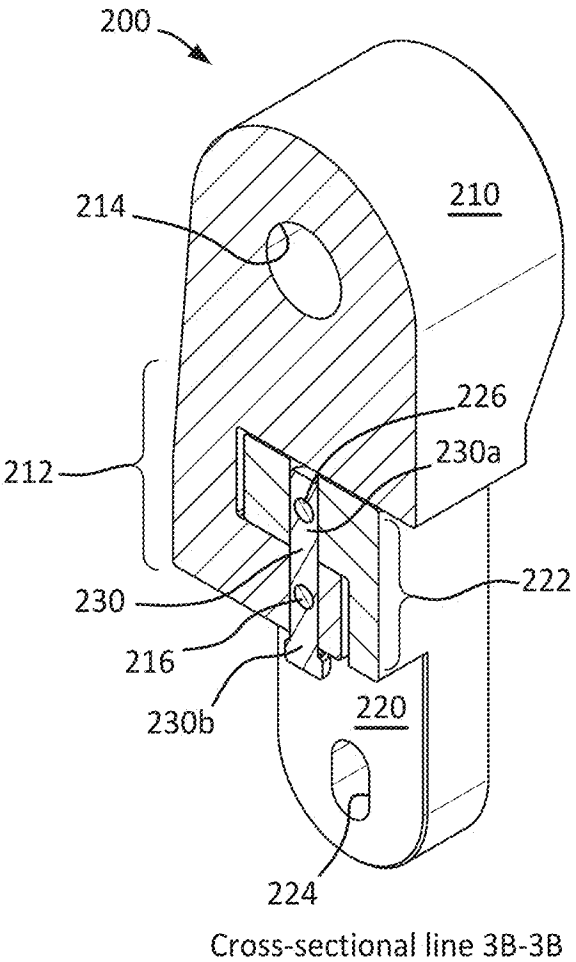
FIGS. 3A through 7B are representative perspective and partial cross-section views of configurations of a breakaway link 200 that can be used to decouple a slips lifter from the slips when rotation of the slips occur, in accordance with certain embodiments.
Figure 3A:
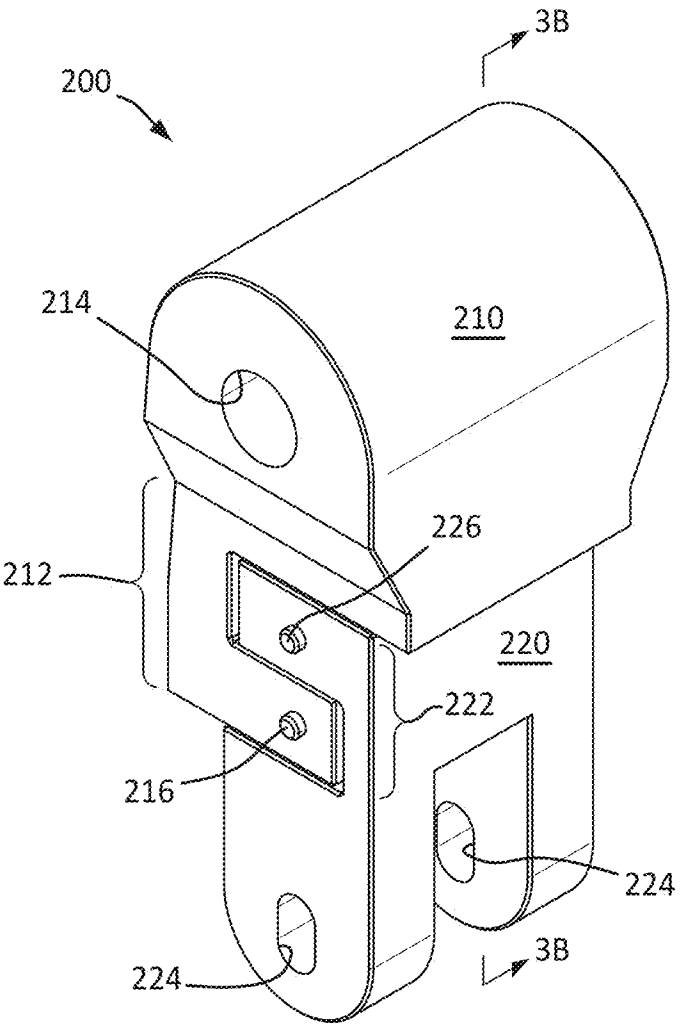

FIGS. 3A and 3B show a non-limiting embodiment of a breakaway link 200, with an upper element 210 and a lower element 220. The bore 214 can receive the pivot 110 to rotationally couple the breakaway link 200 to the lift arm 102. The bore 224 can receive the pivot 114 to rotationally couple the breakaway link 200 to the slips 72. A mating feature 212 of the upper element 210 can engage a mating feature 222 of the lower element 220 to couple the upper element 210 to the lower element 220. The mating interface for this breakaway link 200 can be seen as a flat hook configuration with a flat portion of the lower element 220 extending into a recess space of the mating feature 212 of the upper element 210. A flat hook portion of the upper element 210 can extend into a recess space of the mating feature 222.

The engagement of the mating features 212, 222 can allow the breakaway link 200 to support the slips 72 from the lift arm 102, via the pivots 110, 114. A shear element 230 can extend through portions of the mating features 212, 222 to maintain engagement of the mating features 212, 222 while the slips lifter 100 manipulates the slips 72. However, when the slips 72 are rotated relative to the slips lifter 100, then when pre-determined force is applied to the shear element 230 by either the upper element 210 or the lower element 220, the shear element 230 can fail (e.g., shear into two pieces) and allow the lower element 220 to disengage from the upper element 210 (i.e., the mating features 212, 222 to be unmated or disengaged).

Since it may be undesirable to allow the pieces of the shear element 230 to drop out of the breakaway link 200 once the shear element 230 fails, retention features 216, 226 can be used to retain the pieces of the shear element 230 in their respective elements 210, 220 after the shear element 230 fails. As shown in FIG. 3B, when the shear element 230 fails, the upper end 230*a* (or upper portion) of the shear element 230 can be retained in the mating feature 222 of the lower element 220 by the retention feature 226, and the lower end 230*b* (or lower portion) of the shear element 230 can be retained in the mating feature 212 of the upper element 210 by the retention feature 216. The retention features 216, 226 are arranged perpendicular to the shear element 230, but this perpendicular arrangement is not required. The retention features 216, 226 can be orientated at any angle relative to the shear element 230 as long as the retention features 216, 226 retain the ends 230*a*, 230*b* of the shear element 230 in their respective elements 210, 220.

Figure 4B:
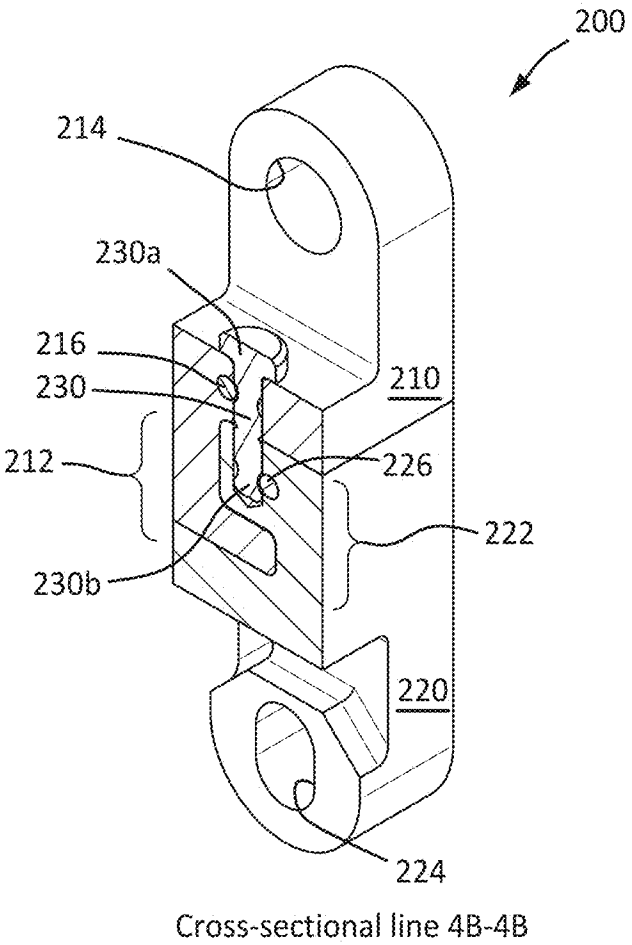
Figure 4A:
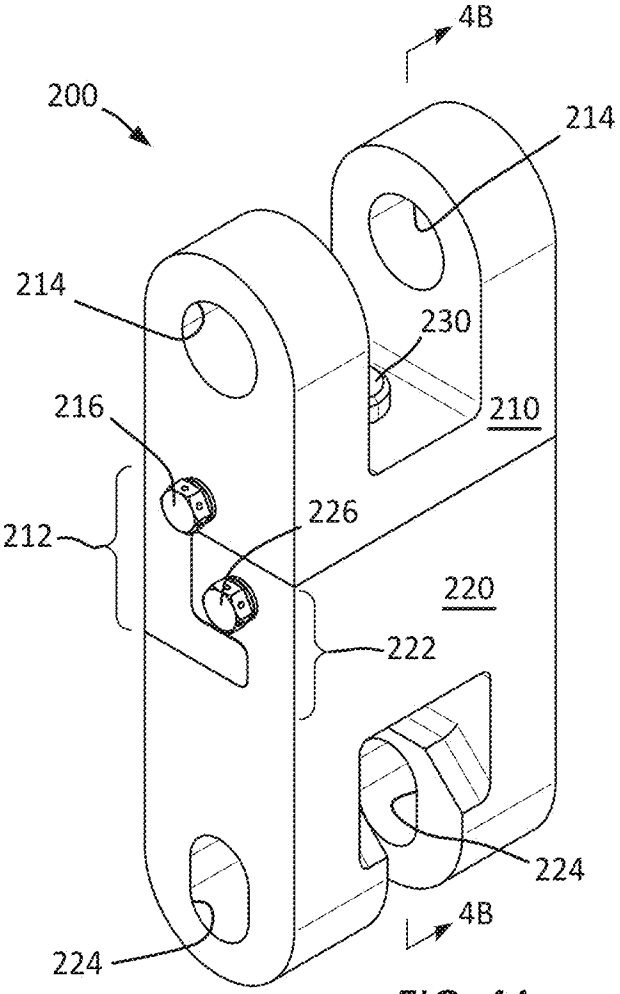

FIGS. 4A and 4B show a non-limiting embodiment of a breakaway link 200, with an upper element 210 and a lower element 220. The breakaway link 200 is similar to the one shown in FIG. 3A, except that the shear element 230 can be installed from the upper element 210 and extend into the lower element 220, and the upper element 210 can include two spaced apart protrusions, each having a bore 214 for receiving the pivot 110. The retention features 216, 226 can be rods with threads at one end to engage the upper or lower element 210, 220 with the rod portions extending to the shear element 230 to engage outer grooves of the shear element 230. If the shear element 230 receives a pre-determined force between the upper element 210 and the lower element 220, the shear element 230 can fail causing the upper end 230*a* to be retained in the upper element 210 by the retention feature 216 and the lower end 230*b* to be retained in the lower element 220 by the retention feature 226. The breakaway link 200 can be repaired by removing the retention features 216, 226, removing the ends 230*a*, 230*b* of the shear element 230, installing a new unbroken shear element 230, and then reinstalling the retention features 216, 226.

Figure 5A:
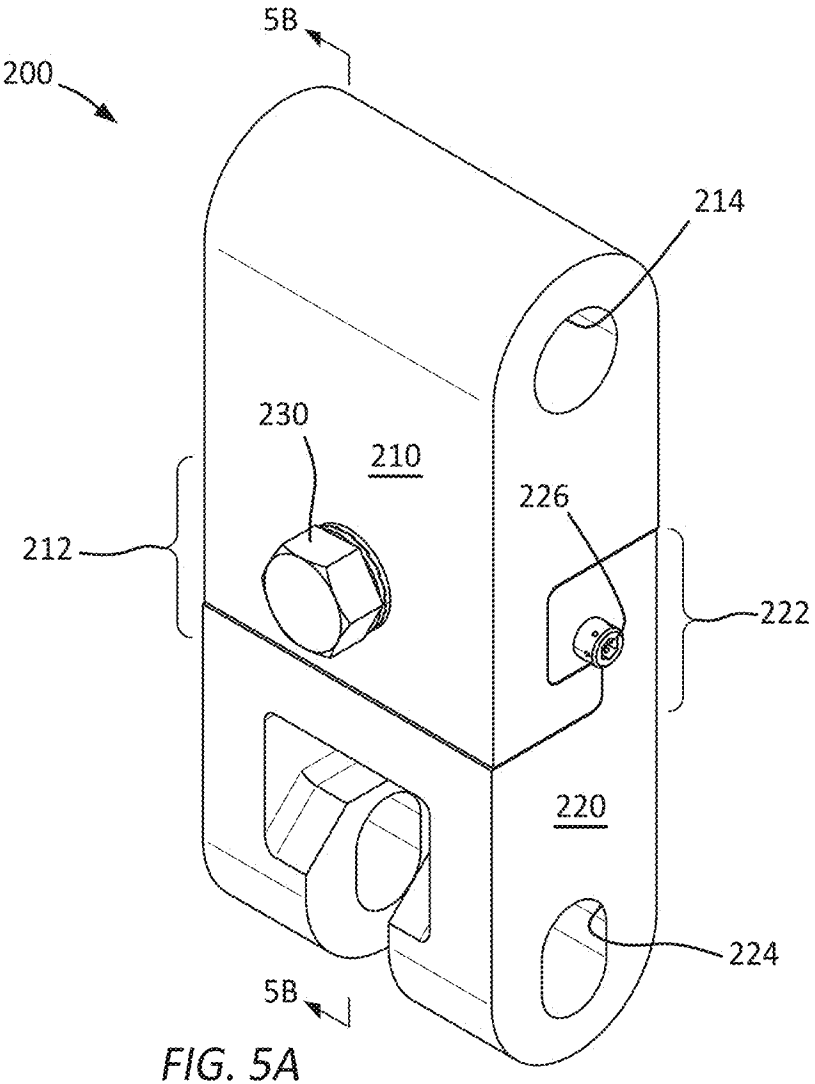
Figure 5B:
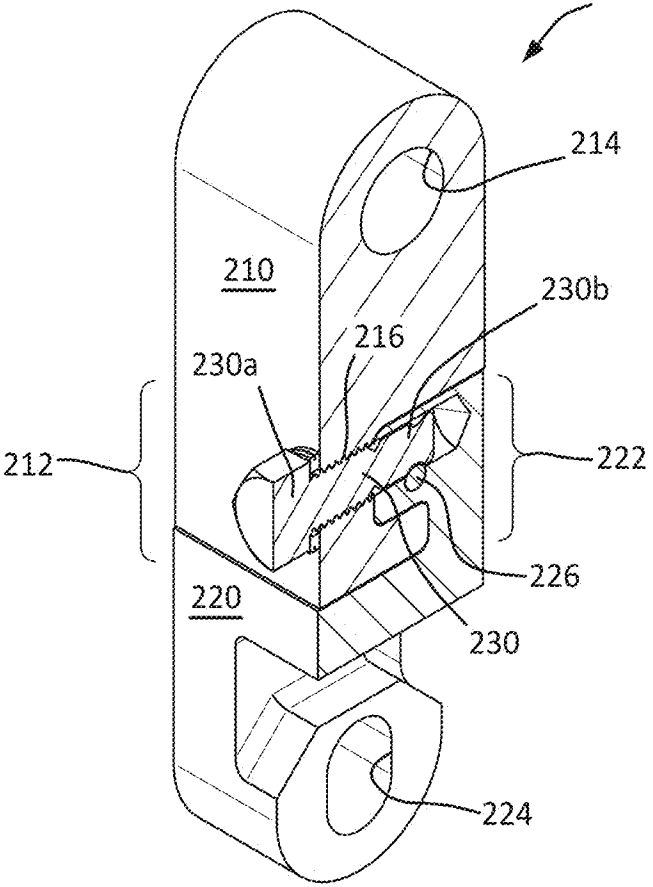

FIGS. 5A and 5B show a non-limiting embodiment of a breakaway link 200, with an upper element 210 and a lower element 220. The breakaway link 200 is similar to the one shown in FIG. 3A, except that the shear element 230 can be installed from a side of the upper element 210 and extend horizontally through the mating feature 212 into the mating feature 222 of the lower element 220. The retention features 216, 226 can be a fastener with threads at one end 230*a* that can act as the retention feature 216, for retaining the end 230*a* in the upper element 210 when then shear element 230 fails. The retention feature 226 can be a rod, like in FIG. 4B, that engages an annular groove in the end 230*b* of the shear element 230 for retaining the end 230*b* in the lower element 220.

If the shear element 230 receives a pre-determined force between the upper element 210 and the lower element 220, the shear element 230 can fail causing the end 230*a* to be retained in the upper element 210 by the retention feature 216 and the lower end 230*b* to be retained in the lower element 220 by the retention feature 226. The breakaway link 200 can be repaired by unscrewing the retention feature 216 from the upper element 210, removing the retention feature 226 from the lower element 220, removing the piece 230*b* of the shear element 230, installing a new unbroken shear element 230, and then reinstalling the retention feature 226.

Figure 6B:
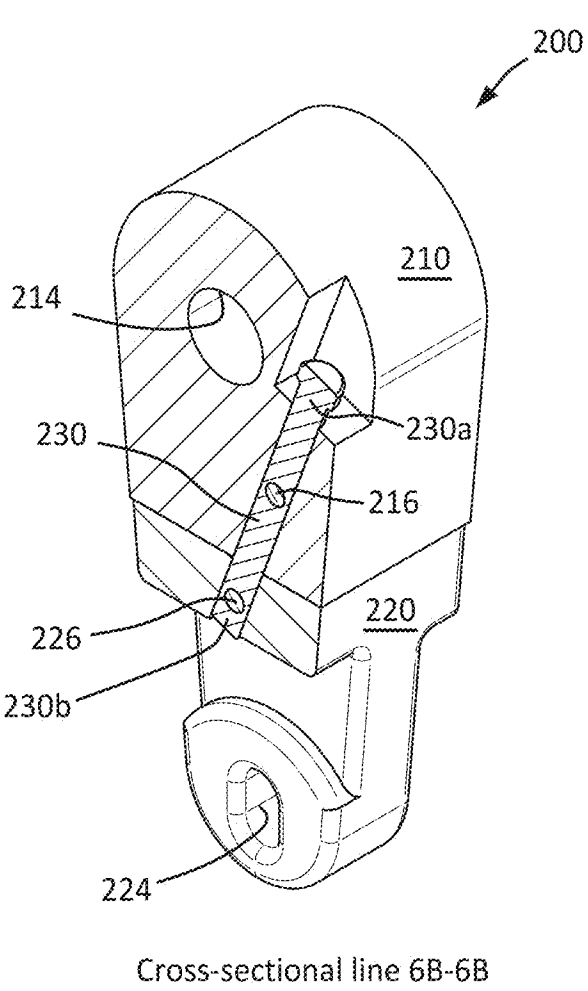
Figure 6A:
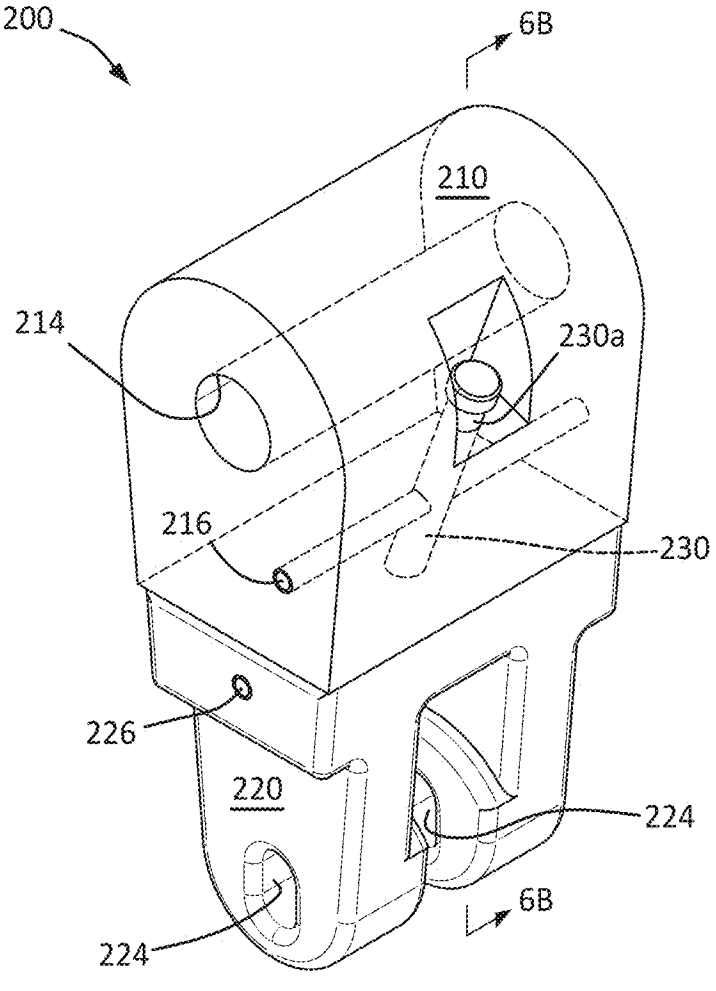

FIG. 6A shows a non-limiting embodiment of a breakaway link 200, with an upper element 210 and a lower element 220. This breakaway link 200 differs from the previous configurations in that it does not include mating features 212, 222. The upper element 210 is coupled to the lower element 220 via the shear element 230, which in this case is used to transfer the lifting force applied to the breakaway link 200 by the lift arm 102, without mating features between the upper and lower elements 210, 220. If the lifting force of the lift arm 102 exceeds the pre-determined force, then the shear element 230 will fail causing the lower element 220 to be decoupled from the upper element 210, with the ends 230*a*, 230*b* of the shear element 230 being retained in the respective upper and lower elements 210, 220 by the respective retention features 216, 226. Additionally, if the slips are rotated with the tubular string 58 and the shear element 230 receives a force greater than the pre-determined force, then the shear element 230 will fail and will decouple the upper element 210 from the lower element 220.

FIG. 6B shows a partial cross sectional view of the breakaway link 200 of FIG. 6A along line 6B-6B. This shows that the shear element 230 can be angled relative to the upper and lower elements 210, 220. The breakaway link 200 can be repaired by removing the retention features 216, 226, removing the ends 230*a*, 230*b* of the shear element 230, installing a new unbroken shear element 230, and then reinstalling the retention features 216, 226.

Figure 7B:
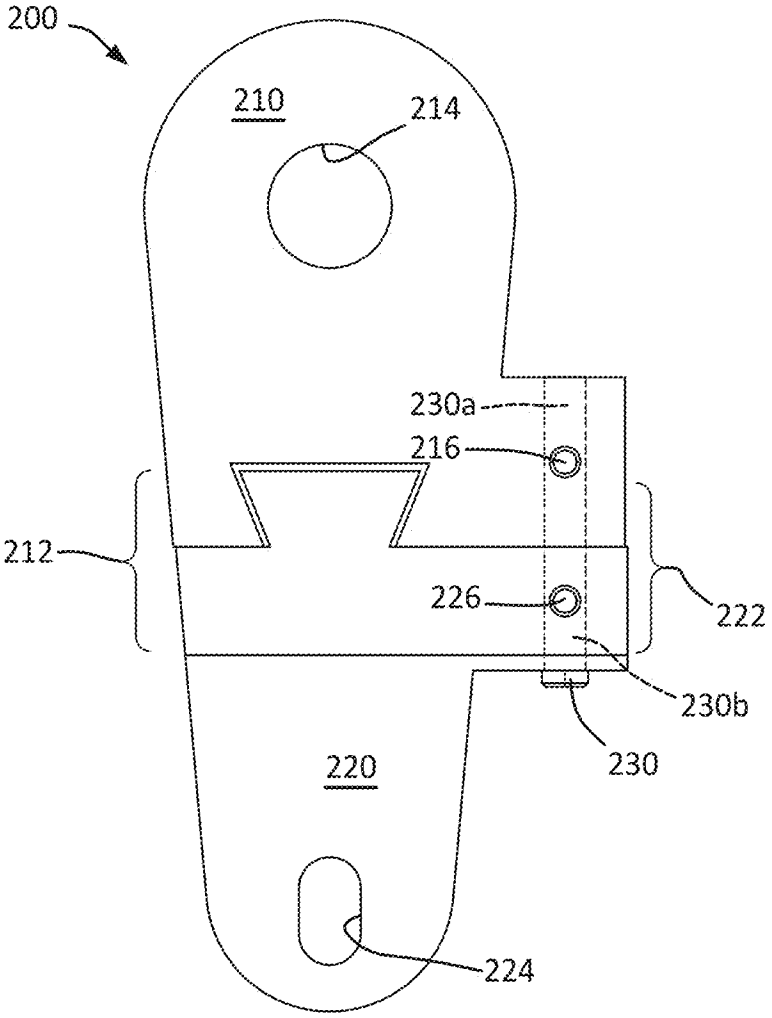
Figure 7A:
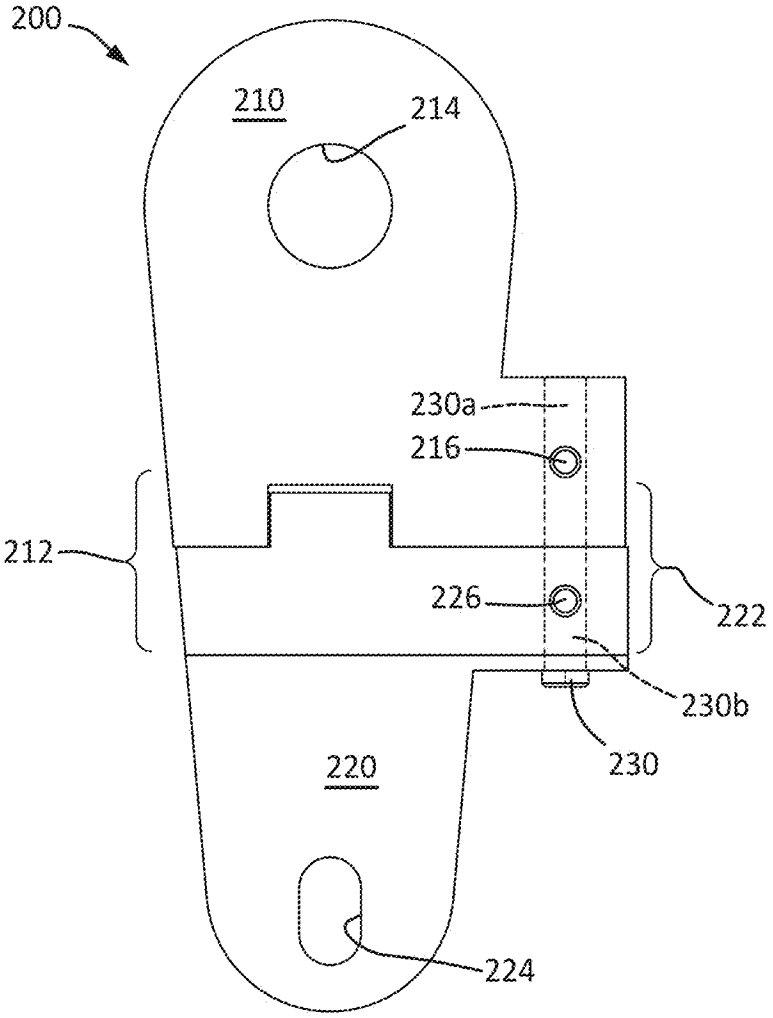

FIGS. 7A and 7B show non-limiting embodiments of a breakaway link 200, with an upper element 210 and a lower element 220. The upper element 210 can engage the lower element 220 via the mating features 212, 222. In FIG. 7A, the mating features 212, 222 can be a groove and a mating ridge, which are not used for transferring a lifting force from the lift arm 102 to the slips 72 via the breakaway link 200. As in FIG. 6A, the upper element 210 can be coupled to the lower element 220 via the shear element 230, which in FIG. 7A can be used to transfer the lifting force applied to the breakaway link 200 by the lift arm 102 to the slips 72, even with mating features between the upper and lower elements 210, 220.

If the lifting force of the lift arm 102 exceeds the pre-determined force, then the shear element 230 can fail causing the lower element 220 to be decoupled from the upper element 210, with the ends 230*a*, 230*b* of the shear element 230 being retained in the respective upper and lower elements 210, 220 by the respective retention features 216, 226. Additionally, if the slips are rotated with the tubular string 58 and the shear element 230 receives a force greater than the pre-determined force, then the shear element 230 can fail and decouple the upper element 210 from the lower element 220.

In FIG. 7B, the mating features 212, 222 can be a groove and mating ridge, such as a dovetail shape, which can be used to transfer a lifting force from the lift arm 102 to the slips 72 via the breakaway link 200. In this case, the mating features 212, 222 can limit vertical movement of the upper element 210 relative to the lower element 220 but can allow horizontal movement between them as in many of the previous configurations. If the slips are rotated with the tubular string 58 and the shear element 230 receives a force greater than the pre-determined force, then the shear element 230 can fail and decouple the upper element 210 from the lower element 220. The ends 230*a*, 230*b* of the shear element 230 can be retained in the respective upper and lower elements 210, 220 by the respective retention features 216, 226, but the shear element 230 may not be required to carry any of the lifting load.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about," "approximately," "generally," or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string, but not limited to the tubulars shown in FIG. 1A. Therefore, in this disclosure, "tubular" is synonymous with "tubular segment," "tubular stand," and "tubular string," as well as "pipe," "pipe segment," "pipe stand," "pipe string," "casing string," "coiled tubing," or "wireline."

It should be noted that the X-Y-Z coordinate axes are indicated in FIGS. XX and XX, where the X-Y-Z coordinate axes are relative to the rig floor 16. The rig floor 16 forms an X-Y plane with the Z axis being substantially perpendicular with the rig floor 16. As used herein, "horizontal," "horizontal position," or "horizontal orientation" refers to a position that is substantially parallel with the X-Y plane. As used herein, "vertical," "vertical position," or "vertical orientation" refers to a position that is substantially perpendicular relative to the X-Y plane or substantially parallel with the Z axis.

Various Embodiments

Embodiment 1. A system for protecting a slips lifter during a subterranean operation, the system comprising:

slips configured to selectively engage a tubular string that extends into a wellbore;

a slips lifter configured to selectively raise or lower the slips; and a link configured to decouple the slips from the slips lifter when the slips are rotated relative to the slips lifter.

Embodiment 2. The system of embodiment 1, wherein the slips lifter raises the slips from or lowers the slips into engagement with the tubular string.

Embodiment 3. The system of embodiment 1, wherein the link comprises a first element and a second element, and wherein the first element is releasably coupled to the second element via a shear element.

Embodiment 4. The system of embodiment 3, wherein the shear element is threadably engaged with the first element and extends from the first element into the second element.

Embodiment 5. The system of embodiment 3, wherein the shear element is threadably engaged with the second element and extends from the second element into the first element.

Embodiment 6. The system of embodiment 3, wherein the shear element fails when the slips are rotated relative to the slips lifter.

Embodiment 7. The system of embodiment 6, wherein the slips are rotated relative to the slips lifter when the slips are engaged with the tubular string and the tubular string is rotated.

Embodiment 8. The system of embodiment 6, wherein the shear element comprises a first portion and a second portion, with the first portion positioned in the first element of the link and the second portion positioned in the second element of the link.

Embodiment 9. The system of embodiment 8, wherein the first portion remains in the first element and the second portion remains in the second element, when the first element is decoupled from the second element.

Embodiment 10. The system of embodiment 8, further comprising:

a first retention feature that engages the first portion of the shear element; and a second retention feature that engages the second portion of the shear element.

Embodiment 11. The system of embodiment 10, wherein the first retention feature retains the first portion in the first element of the link when the shear element fails, and wherein the second retention feature retains the second portion in the second element of the link when the shear element fails.

Embodiment 12. The system of embodiment 10, wherein the first retention feature is external threads at one end of the shear element and the external threads engage internal threads of the first element or the second element.

Embodiment 13. The system of embodiment 3, wherein the first element comprises a first mating feature and the second element comprises a second mating feature, and wherein the first mating feature engages with the second mating feature to couple the first element to the second element.

Embodiment 14. The system of embodiment 3, wherein the first mating feature and the second mating feature, when engaged with each other, transfer a tension or compression force from between the first element and the second element of the link.

Embodiment 15. The system of embodiment 1, wherein the slips lifter comprises:

a base that is fixedly coupled to a rig floor; and a lift arm rotationally coupled to the base via a first pivot at one end and coupled to the link at an opposite end via a second pivot.

Embodiment 16. The system of embodiment 15, wherein the link is coupled to the slips via a third pivot, and wherein upward rotation of the lift arm relative to the base lifts the slips via the link and downward rotation of the lift arm relative to the base lowers the slips via the link, when a shear element remains undamaged.

Embodiment 17. The system of embodiment 16, wherein the lift arm is decoupled from the slips, when the shear element fails.

Embodiment 18. The system of embodiment 17, wherein the shear element fails in response to a shear force applied to the shear element that exceeds a pre-determined force.

Embodiment 19. A method for protecting a slips lifter during a subterranean operation, the method comprising:

coupling a slips lifter, via a link, to slips on a rig floor;

engaging the slips to a tubular;

rotating the slips relative to the slips lifter; and decoupling the slips from the slips lifter by decoupling a first element of the link from a second element of the link in response to rotation of the slips.

Embodiment 20. The method of embodiment 19, further comprising:

installing a shear element in the link that extends through a portion of the first element and into a portion of the second element.

Embodiment 21. The method of embodiment 20, wherein decoupling the first element from the second element comprises the shear element failing and separating into a first portion and a second portion.

Embodiment 22. The method of embodiment 21, further comprising:

retaining, via a first retention feature, the first portion in the first element when the shear element fails; and retaining, via a second retention feature, the second portion in the second element when the shear element fails.

Embodiment 23. The method of embodiment 19, further comprising:

engaging a first mating feature of the first element with a second mating feature of the second element, thereby coupling the first element to the second element; and installing a shear element in the link to maintain engagement of the first mating feature with the second mating feature, until a pre-determined force is applied to the shear element.

Embodiment 24. The method of embodiment 23, further comprising:

failing the shear element in response to applying the pre-determined force; and disengaging the first mating feature from the second mating feature due to the failing of the shear element.

Embodiment 25. The method of embodiment 24, further comprising:

decoupling the first element from the second element due to the failing of the shear element.

Embodiment 26. A system for protecting a slips lifter during a subterranean operation, the system comprising:

slips configured to selectively engage a tubular string that extends into a wellbore;

a slips lifter configured to selectively raise or lower the slips; and a link configured to decouple the slips from the slips lifter when the slips lifter attempts to lift the slips with the slips engaged with the tubular string.

Embodiment 27. The system of embodiment 26, wherein the slips lifter applies a pre-determined force to the link when the slips lifter attempts to lift the slips with the slips engaged with the tubular string.

Embodiment 28. The system of embodiment 27, wherein the link comprises a first element and a second element, and wherein the first element is releasably coupled to the second element via a shear element, and wherein the pre-determined force causes the shear element to fail.

Embodiment 29. The system of embodiment 28, wherein the shear element is threadably engaged with the first element and extends from the first element into the second element.

Embodiment 30. The system of embodiment 28, wherein the shear element is threadably engaged with the second element and extends from the second element into the first element.

Embodiment 31. The system of embodiment 28, wherein the shear element comprises a first portion and a second portion, with the first portion positioned in the first element of the link and the second portion positioned in the second element of the link.

Embodiment 32. The system of embodiment 31, wherein the first portion remains in the first element and the second portion remains in the second element when the first element is decoupled from the second element.

Embodiment 33. The system of embodiment 31, further comprising:

a first retention feature that engages the first portion of the shear element; and a second retention feature that engages the second portion of the shear element.

Embodiment 34. The system of embodiment 33, wherein the first retention feature retains the first portion in the first element of the link when the shear element fails, and wherein the second retention feature retains the second portion in the second element of the link when the shear element fails.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A system for protecting a slips lifter during a subterranean operation, the system comprising:

slips configured to selectively engage a tubular string that extends into a wellbore;

a slips lifter configured to selectively raise or lower the slips; and a link configured to decouple the slips from the slips lifter when the slips are rotated relative to the slips lifter.

2. The system of claim 1, wherein the slips lifter raises the slips from or lowers the slips into engagement with the tubular string.

3. The system of claim 1, wherein the link comprises a first element and a second element, and wherein the first element is releasably coupled to the second element via a shear element.

4. The system of claim 3, wherein the shear element is threadably engaged with the first element and extends from the first element into the second element, or the shear element is threadably engaged with the second element and extends from the second element into the first element.

5. The system of claim 3, wherein the shear element fails when the slips are rotated relative to the slips lifter.

6. The system of claim 5, wherein the slips are rotated relative to the slips lifter when the slips are engaged with the tubular string and the tubular string is rotated.

7. The system of claim 1, wherein the slips lifter comprises:

a base that is fixedly coupled to a rig floor; and a lift arm rotationally coupled to the base via a first pivot at one end and coupled to the link at an opposite end via a second pivot.

8. The system of claim 7, wherein the link is coupled to the slips via a third pivot, and wherein upward rotation of the lift arm relative to the base lifts the slips via the link and downward rotation of the lift arm relative to the base lowers the slips via the link, when a shear element remains undamaged.

9. The system of claim 8, wherein the lift arm is decoupled from the slips, when the shear element fails.

10. The system of claim 9, wherein the shear element fails in response to a shear force applied to the shear element that exceeds a pre-determined force.

11. A method for protecting a slips lifter during a subterranean operation, the method comprising:

coupling a slips lifter, via a link, to slips on a rig floor;

engaging the slips to a tubular;

rotating the slips relative to the slips lifter; and decoupling the slips from the slips lifter by decoupling a first element of the link from a second element of the link in response to rotation of the slips.

12. The method of claim 11, further comprising:

installing a shear element in the link that extends through a portion of the first element and into a portion of the second element.

13. The method of claim 12, wherein decoupling the first element from the second element comprises the shear element failing and separating into a first portion and a second portion.

14. The method of claim 11, further comprising:

engaging a first mating feature of the first element with a second mating feature of the second element, thereby coupling the first element to the second element; and installing a shear element in the link to maintain engagement of the first mating feature with the second mating feature, until a pre-determined force is applied to the shear element.

15. The method of claim 14, further comprising:

failing the shear element in response to applying the pre-determined force; and disengaging the first mating feature from the second mating feature due to the failing of the shear element.

16. The method of claim 15, further comprising:

decoupling the first element from the second element due to the failing of the shear element.

17. A system for protecting a slips lifter during a subterranean operation, the system comprising:

slips configured to selectively engage a tubular string that extends into a wellbore;

a slips lifter configured to selectively raise or lower the slips; and a link configured to decouple the ships from the ships lifter when the ships lifter attempts to lift the slips with the slips engaged with the tubular string, wherein the slips lifter applies a pre-determined force to the link when the slips lifter attempts to lift the slips with the slips engaged with the tubular string.

18. The system of claim 17, wherein the link comprises a first element and a second element, and wherein the first element is releasably coupled to the second element via a shear element, and wherein the pre-determined force causes the shear element to fail.

19. The system of claim 18, wherein the shear element is threadably engaged with the first element and extends from the first element into the second element, or the shear element is threadably engaged with the second element and extends from the second element into the first element.

* * * * *